US008448362B2

(12) United States Patent
Harris

(10) Patent No.: US 8,448,362 B2
(45) Date of Patent: May 28, 2013

(54) CURVED DISPLAY ARRANGEMENT

(76) Inventor: Miles Andrew Harris, Halifax (GB)

( * ) Notice: Subject to any disclaimer, the term of this patent is extended or adjusted under 35 U.S.C. 154(b) by 0 days.

(21) Appl. No.: 13/519,475

(22) PCT Filed: Jan. 24, 2011

(86) PCT No.: PCT/GB2011/000076
§ 371 (c)(1),
(2), (4) Date: Jun. 27, 2012

(87) PCT Pub. No.: WO2011/092455
PCT Pub. Date: Aug. 4, 2011

(65) Prior Publication Data

US 2012/0297651 A1 Nov. 29, 2012

(30) Foreign Application Priority Data

Jan. 27, 2010 (GB) ..... 1001270.6
May 10, 2010 (GB) ..... 1007717.0
Nov. 19, 2010 (GB) ..... PCT/GB2010/002127

(51) Int. Cl.
*G09F 15/00* (2006.01)

(52) U.S. Cl.
USPC ..... 40/604; 40/606.12

(58) Field of Classification Search
USPC ..... 40/603, 604, 606.11, 606.12, 738
See application file for complete search history.

(56) References Cited

U.S. PATENT DOCUMENTS

| | | | | |
|---|---|---|---|---|
| 2,814,135 | A * | 11/1957 | Freeman | 38/66 |
| 5,667,855 | A | 9/1997 | Borden et al. | |
| 7,213,355 | B2 * | 5/2007 | Aires | 40/604 |
| 2002/0121034 | A1 * | 9/2002 | Schmitt | 40/604 |
| 2004/0159753 | A1 | 8/2004 | LaMotte | |
| 2005/0166430 | A1 | 8/2005 | Zarelius | |
| 2005/0198875 | A1 | 9/2005 | Herrin | |
| 2009/0056184 | A1 | 3/2009 | Fritsche et al. | |

OTHER PUBLICATIONS

International Search Report for corresponding International Application No. PCT/GB2011/000076.

* cited by examiner

*Primary Examiner* — Casandra Davis
(74) *Attorney, Agent, or Firm* — Egbert Law Offices, PLLC

(57) ABSTRACT

A display arrangement comprises a banner, one edge of which is secured to a hollow, flexible rod. A spring arrangement is located within the rod. The spring arrangement comprises a spring that extends along a predetermined length of the rod and an elastic band that is looped through the length of the rod down the interior of the spring and around the exterior of the rod. The banner may be curved and posed by flexing the rod at the location of the spring. This curve is then retained in the banner by a balancing tension in the exterior portion of the elastic band between the ends of the rod. In some embodiments, the display arrangement is connected to one or more similar arrangements so that their banners form a continuous display.

17 Claims, 5 Drawing Sheets

CURVED DISPLAY ARRANGEMENT

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a curvable display arrangement for use in the presentation of graphical or pictorial information.

2. Description of Related Art Including Information Disclosed Under 37 CFR 1.97 and 37 CFR 1.98.

Display arrangements for use in the presentation of information conventionally comprise large banners of paper or plastics material that are printed with images or graphics for use in advertising and decorative purposes in retail outlets, exhibitions and other similar contexts. Such arrangements may be hung from walls and ceilings or be mounted on a stand. However, in many situations it would be advantageous for the banner to curve around the corners of a display area or for the end of a banner to be recurved to provide an attractive and finished appearance when viewed from the side. However, such banners are usually made from materials such as plastics sheeting or paper that is not capable of self-supporting such curves.

An object of the present invention is to provide a curvable display arrangement that fulfils this requirement. A further object is to provide a portable display arrangement that incorporates a curvable banner.

BRIEF SUMMARY OF THE INVENTION

According to the present invention there is provided a display arrangement comprising a first banner; a hollow, flexible first rod secured to one edge of the first banner; and a first spring arrangement located within the first rod, the spring arrangement comprising a spring that extends along a predetermined length of the rod and an elastic band that is looped through the length of the rod down the interior of the spring and around the exterior of the rod such that flexing of the first rod at the location of the spring creates a curve in the banner that is then retained in position by a balancing tension in the exterior portion of the elastic band between the ends of the first rod.

Preferably, the first banner is secured to a flexible second rod on an edge opposing said one edge. Advantageously, the second rod is hollow comprises a second spring arrangement similar to the first spring arrangement.

Preferably also, the first and second rods each comprise a flexible central section and rigid ends.

Preferably also, the flexible central section of each rod comprises a substantially hollow extrusion with a projecting flange to which the first banner is secured.

Preferably also, the spring is a helical spring that runs along the full length of the central section of at least the first rod.

Preferably also, the elastic band comprises a loop of elastic cord.

Advantageously, the arrangement is adapted to be connected to a similar second arrangement comprising a second banner adapted to form a continuous display when located side-by-side with the first banner.

Other preferred but non-essential features of the various aspects of the present invention are described in the dependent claims appended hereto.

BRIEF DESCRIPTION OF THE DRAWINGS

The present invention will now be described by way of example with reference to the accompanying drawings, in which.

DETAILED DESCRIPTION OF THE INVENTION

Figure 1:
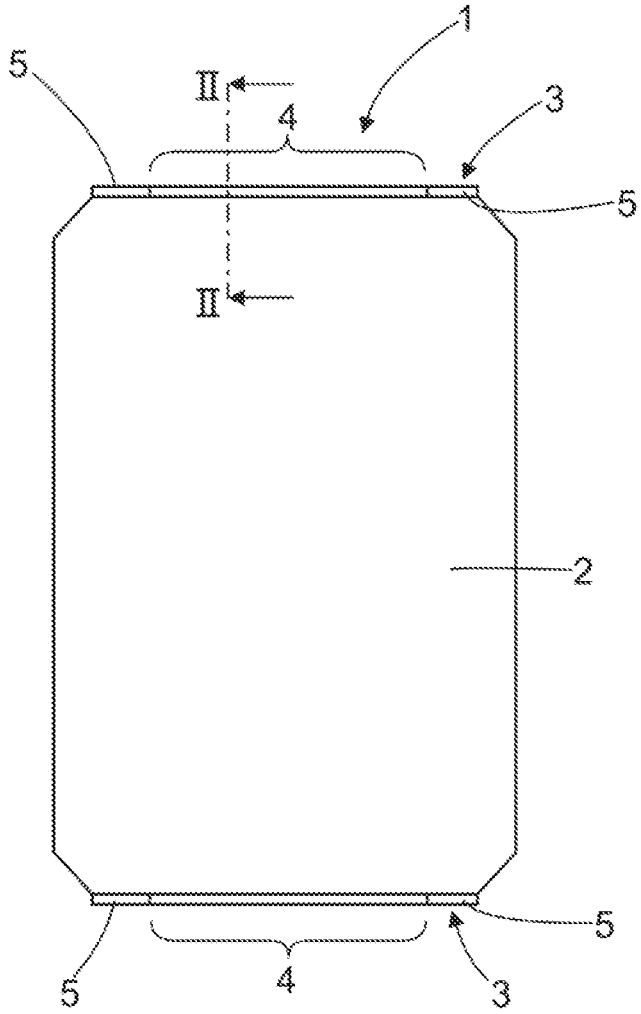
FIG. 1 is a schematic front elevation of a first embodiment of curvable display arrangement in accordance with the present invention.

Referring firstly to FIG. 1, a first embodiment of display arrangement 1 in accordance with the present invention comprises a curvable banner 2 that is printed with the required graphical or pictorial information. For this purpose the banner 2 may be made of any flexible material suitable for use as a banner. However, preferably the banner is made from a flexible material that can be readily rolled up for storage but that can be posed as desired when the banner 2 is unrolled for display. In most conventional display arrangements, such material is usually a plastics laminate that can be printed. A highly suitable laminate is one having a layer comprised of polyethylene terephthalate (PET) that is coated with polyvinyl chloride (PVC), preferably on both sides so that the laminate will lie flat when unrolled. This laminate is strong and yet is lightweight and can be readily rolled up for storage and transportation.

The banner 2 is secured to rods 3 along its top and bottom edges respectively. To enable the banner 2 to be curved, typically around a vertical axis, the rods 3 are hollow and flexible along at least a central section 4 of their length. The ends 5 of the rods 3 are preferably rigid but are also hollow. The rods 3 allows the display arrangement to be connected to one or more other display arrangements on either side thereof, as is described below with particular reference to FIGS. 4 and 5, and also permit the banner 2 to be posed in a curved position as will now be described.

Figure 3A:
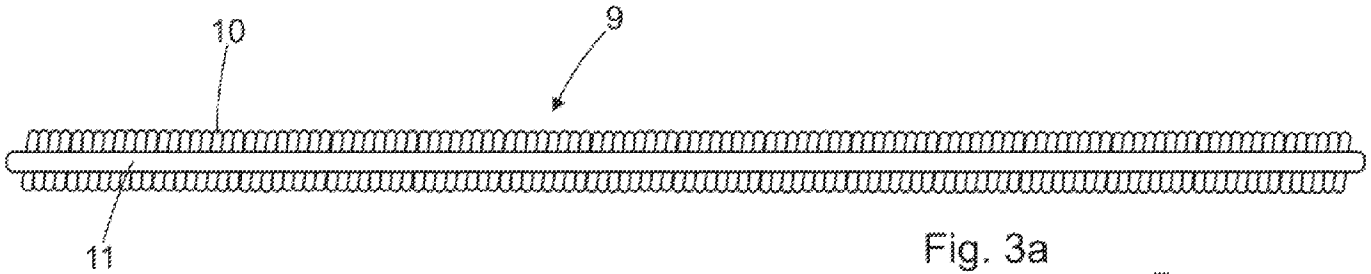
FIGS. 3*a* and 3*b* are plan views of a spring arrangement shown in FIG. 2 in unflexed and a flexed positions respectively.
Figure 2:
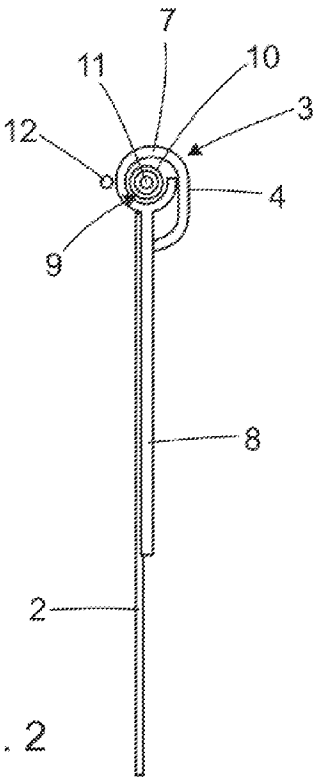
FIG. 2 is a transverse cross-sectional view along the line II-II in FIG. 1.
Figure 3B:
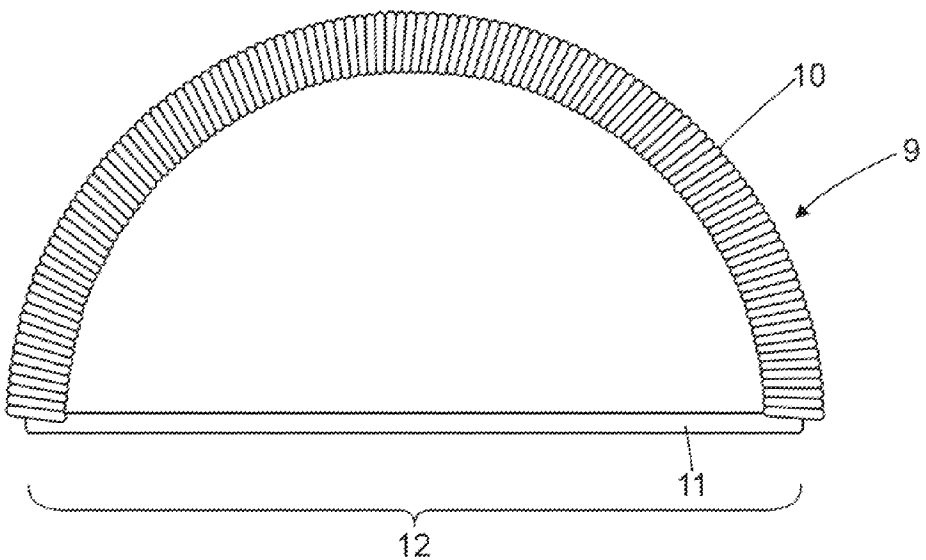

The flexible central section 4 of each of the rods 3 may be made of any appropriate material, such as neoprene, and may, for example, comprise an extrusion as shown in FIG. 2. This extrusion comprises a flexible hollow portion 7 with a flexible projecting flange 8 to which the banner 2 is secured, for example by an adhesive. The flange 8 assists in supporting the banner 2 when posed in a curved position. Located within the hollow portion 7 is a spring arrangement 9. The spring arrangement 9 is as shown in FIGS. 3*a* and 3*b* and comprises a spring 10 and an elastic band 11. Preferably, the spring 10 is a helical spring that runs along the full length of the central section 4 of the rod 3. The elastic band 11 is looped through the whole length of the rod 3, passing down the interior of the spring 10 and around the exterior of the rod 3. The band 11 is preferably made from a length of elastic cord such as latex elastic or slip elastic as is commonly used by anglers. The two ends of the cord are then joined together by tying or a clip to make the continuous band 11. The band 11 is freely movable through the spring 10 and around the outside of the rod 3.

In a specific, non-limiting embodiment of the invention, the spring 10 may have an outside diameter of 7 mm and the cord making the elastic band 11 may have an outside diameter of 2 mm. The length of the spring 10 is dependent on the size of the banner 2 and the length of the rod 3. Typically such banners 2 are either 600 mm or 800 mm wide and the length of the flexible central section 4 of the rods is either 350 mm or 550 mm respectively, the rigid ends 5 of the rod 4 each being 125 mm in length.

When the hollow portions 7 of each of the rods 3 attached to the banner 2 are flexed at the location of the spring 10 to produce a curve in the banner 2, the tension in the portion 12 (see FIGS. 2 & 3*b*) of the elastic band 11 outside the rod 3 is variable owing to the fact that the band 11 is freely movable relative to the spring 10. This allows the spring 10 and thereby the rod 3 to be set to a desired curve by virtue of a balancing tension in the exposed portion of the elastic band 12 between the ends of the rod 3. Hence, the banner 2 can be curved and posed in a particular curved position.

Figure 4:
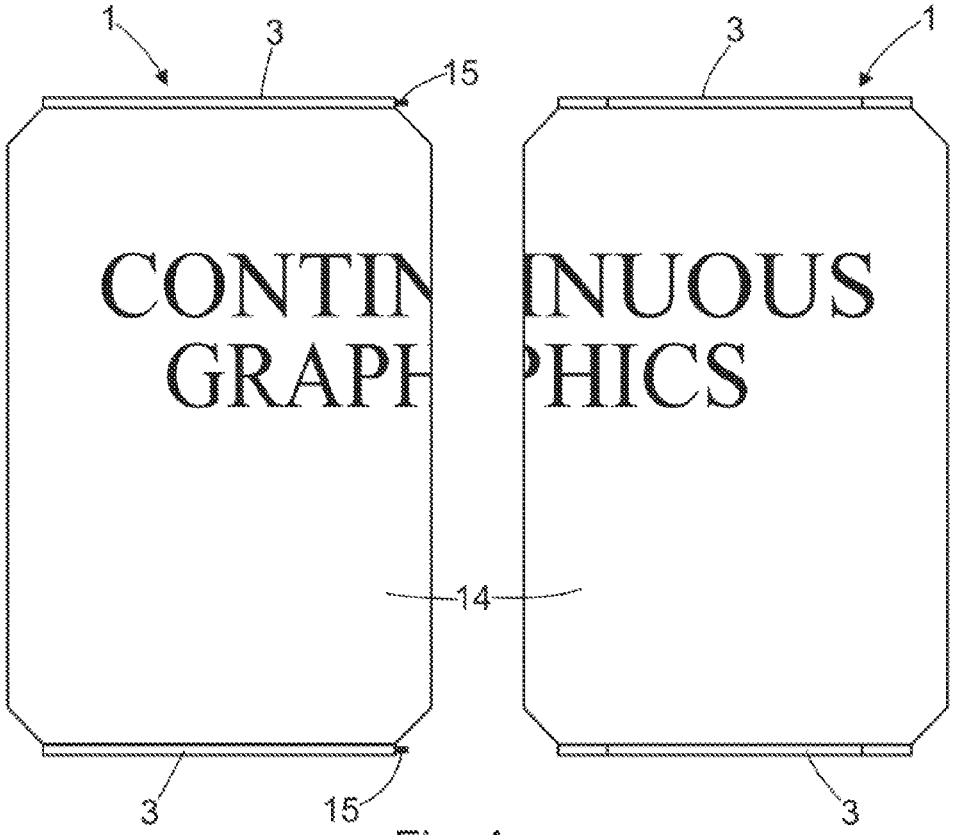
FIG. 4 is a schematic front elevation of a two arrangements similar to that shown in FIG. 1 which are adapted to be displayed side-by side to form a continuous curvable display arrangement but prior to this arrangement being formed.
Figure 5:
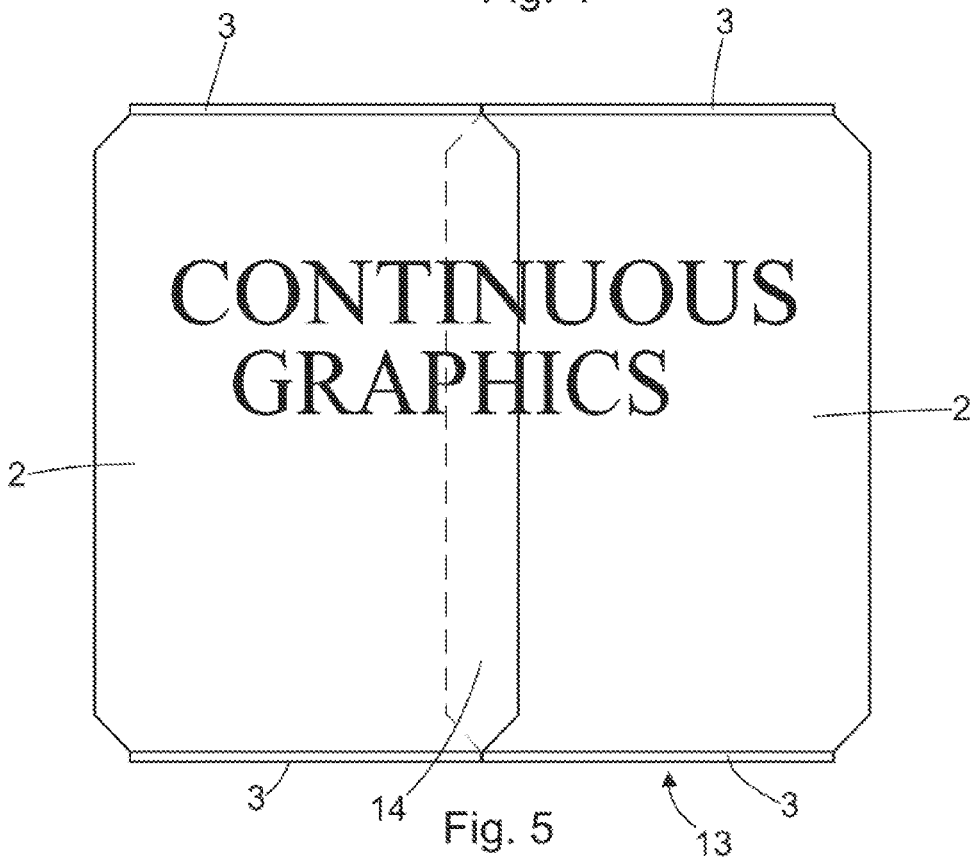
FIG. 5 is a view similar to FIG. 4 showing the arrangement after the curvable display arrangement has been formed.

A second embodiment of display arrangement 13 in accordance with the present invention comprises two or more arrangements 1 that are adapted to be connected together such that their respective banners 2 form a continuous display when located side-by side, as shown in FIGS. 4 and 5. The banners 2 are printed with the required graphical or pictorial information but adjacent edges of the banners 2 are adapted to overlap one another by predetermined overlap areas 14 that are printed with identical material. This means that when the banners 2 are overlapped and connected together they form a continuous display, as shown in FIG. 5, so that from a distance it can be hard to detect that the two banners 2 are not a single banner. It is also possible to connect a display arrangement 1 in accordance with the present arrangement in a similar way to banner arrangements that are not designed to be curved or flexed or to a combination of curvable display arrangements 1 and non-curvable display arrangements, as shown in FIG. 7.

The display arrangements are connected together by connecting the rods 3 at the top of the banners 2 the rods 3 and the bottom of the banners 2 by spigot arrangements in a male/female joint. As shown in FIG. 4, one end 5 of each of the rods 3 at the top and the bottom of one of the banners 2 is provided with a projecting spigot 15 that is capable of being inserted into the hollow end 5 of the adjacent rod 3 of the other banner. In an alternative arrangement, the spigot 15 is an independent element that is then inserted into hollow ends 5 of both adjacent rods 3. In this way the two banners 2 are retained in a side-by-side relationship with their predetermined overlap areas 14 overlapping one another to provide a visually seamless display.

Such curving display arrangements 1, 13 as described above may be hung directly on a wall or partition, for example a partition dividing booths used in an exhibition hall. This is achieved by using blocks that clip to the upper rod or rods 3 and that are attached to the wall or partition using a hook fastener or other means so that the banner 2 hangs a small way clear of the wall or partition to avoid obstructions such as fasteners used to connect the partitions together. Alternatively, the arrangements 1 and 13 can form part of a free-standing display 16 as will now described with reference to FIGS. 6 and 7, it being appreciated that such a curvable display arrangement may be made up of any number of interconnected banners or a single banner.

Figure 6:
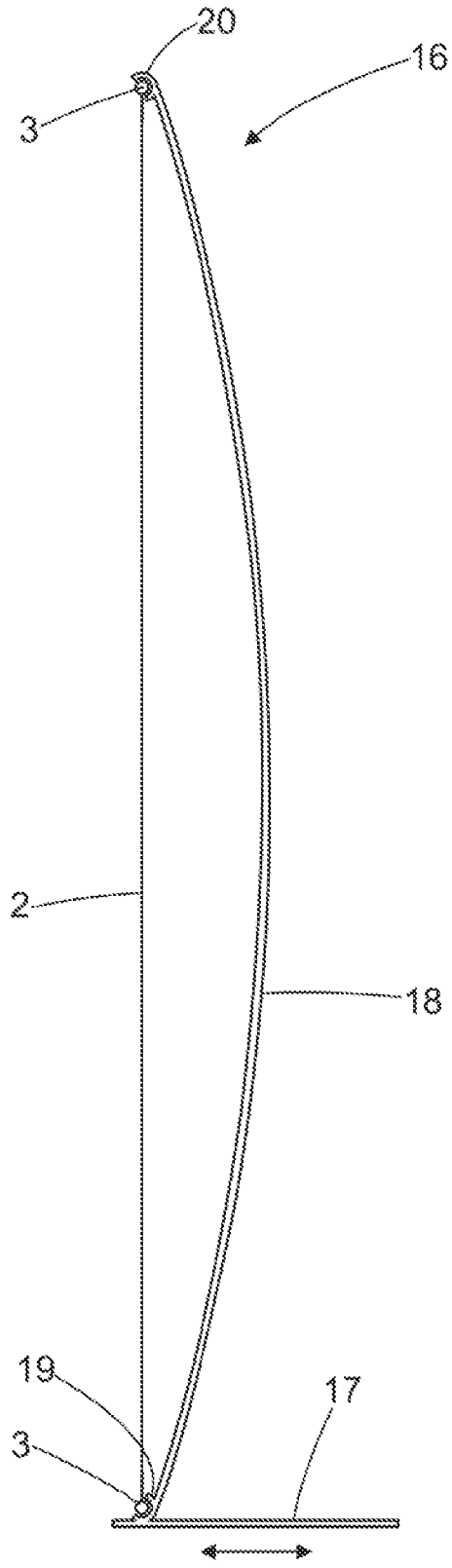
FIG. 6 is a schematic side view of a free-standing display comprising a display arrangement as shown in FIG. 1.
Figure 7:
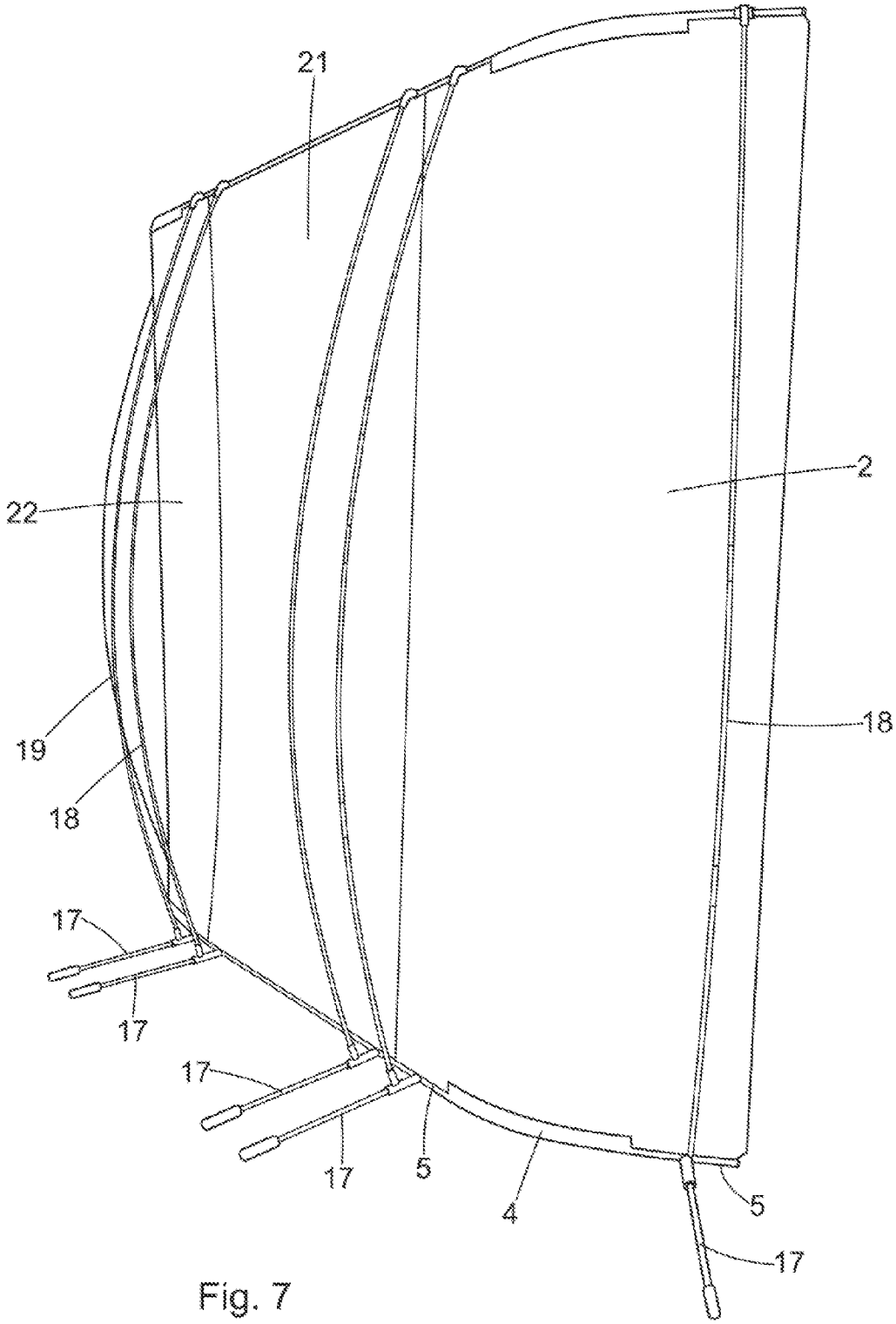
FIG. 7 is a rear view of a free-standing display similar to that shown in FIG. 6 but comprising three banners, the outer two forming part of curvable display arrangements in accordance with the present invention.

As shown in FIGS. 6 and 7, in the free-standing display 16 a plurality of feet 17 and upright, flexible tensioning poles 18 are connected to the rods 3 of the arrangement 1, 13. Each foot 17 extends horizontally, typically rearwards of the banner 2 but may be slidable between forward and rearward positions, and is secured to a clip 19 that is attached to the rod 3 at the bottom of the banner 2. Each foot 17 is connected to the lower end of one of the poles 18, the other end of which also carries a clip 20 that is attached to the rod at the top of the banner 2. The flexibility of the poles 18 tension the banner 2 so that it is retained upright without sagging. An appropriate number of feet 17 and poles 18 may be used to support the display arrangement 1, 13. It is conceivable that in some arrangements one foot 17, if appropriately stable, and one tensioning pole 18 per banner 2 may be sufficient but typically two feet 17 and two tensioning poles 18 will be used for each banner 2 of the display arrangement as shown in FIG. 7. This shows three interconnected banners 2, 21 and 22, the end banners 2 and 22 being curved as described above and the central banner 21 being flat. When it is desired to demount such a display 17, the rods 3 of the banners 2, 21, 22 are disconnected from the clips 19 and 20 and detached from one another. The banners 2, 21 and 22 can then be simply rolled up around one of their rods 3 for transportation or storage. Preferably, the poles 19 are made in two or more sections that can also be separated from each other and from the feet 18 for ease of transportation.

I claim:

1. A display arrangement comprising a first banner;

a hollow, flexible first rod secure to one edge of the first banner; and a first spring arrangement located within the first rod, the spring arrangement comprising a spring that extends along a predetermined length of the rod and an elastic band that is looped through the length of the rod down the interior of the spring and around the exterior of the rod such that flexing of the first rod at the location of the spring creates a curve in the banner that is then retained in position by a balancing tension in the exterior portion of the elastic band between the ends of the first rod.

2. An arrangement as claimed in claim 1, wherein the first banner is secured to a flexible second rod on an edge opposing said one edge.

3. An arrangement as claimed in claim 2, wherein the second rod is hollow comprises a second spring arrangement similar to the first spring arrangement.

4. An arrangement as claimed in claim 2, wherein the first and second rods are adapted to be connected to a stand.

5. An arrangement as claimed in claim 4, wherein the stand is adapted to be clipped to the first and second rods.

6. An arrangement as claimed in claim 4, wherein the stand comprise at least one foot and at least one upright, flexible tensioning pole.

7. An arrangement as claimed in claim 6, wherein the foot is connected to a lower end of the pole and is slidable between forward and rearward positions.

8. An arrangement as claimed in claim 2, wherein the first and second rods each comprise a flexible central section and rigid ends.

9. An arrangement as claimed in claim 8, wherein the flexible central section of each rod comprises a substantially hollow extrusion with a projecting flange to which the first banner is secured.

10. An arrangement as claimed in claim 8, wherein the spring is a helical spring that runs along the full length of the central section of at least the first rod.

11. An arrangement as claimed in claim 1, wherein the elastic band comprises a loop of elastic cord.

12. An arrangement as claimed in claim 1, that is adapted to be connected to a similar second arrangement comprising a second banner adapted to form a continuous display when located side-by-side with the first banner.

13. An arrangement as claimed in claim 12, wherein adjacent edges of the first and second banners are adapted to overlap one another by a predetermined overlap area, the overlap area of the first banner bearing identical material to the overlap area of the second banner.

14. An arrangement as claimed in claim 12, wherein the first rods of the first and second arrangements are adapted to connect together by means of a spigot that joins to at least one of the first rods of the first arrangement or a first rod of the second arrangement in a male/female joint.

15. An arrangement as claimed in claim 14, wherein the spigot projects from an end of one of the first rods and is capable of being inserted into a hollow end of the other first rod.

16. An arrangement as claimed claim 1, wherein the banner comprise a printable, flexible plastics laminate.

17. An arrangement as claimed in claim 1, wherein the banner or banners comprise a printable flexible laminate made up a layer comprised of polyethylene terephthalate (PET) that has coatings on both sides comprised of polyvinyl chloride (PVC).

* * * * *